US006932745B1

(12) United States Patent
Ellis

(10) Patent No.: US 6,932,745 B1
(45) Date of Patent: Aug. 23, 2005

(54) SEATED STEPPER

(75) Inventor: Patrick D. Ellis, Milwaukee, WI (US)

(73) Assignee: Northland Industries, Inc., South Milwaukee, WI (US)

( * ) Notice: Subject to any disclaimer, the term of this patent is extended or adjusted under 35 U.S.C. 154(b) by 0 days.

(21) Appl. No.: 10/757,194

(22) Filed: Jan. 14, 2004

(51) Int. Cl.[7] ..... A63B 21/00; A63B 69/06
(52) U.S. Cl. ..... 482/52; 482/57
(58) Field of Search ..... 482/51, 52–53, 482/57, 63, 62, 70–73

(56) References Cited

U.S. PATENT DOCUMENTS

| | | | | |
|---|---|---|---|---|
| 4,757,988 | A * | 7/1988 | Szymski | 482/59 |
| 4,900,013 | A | 2/1990 | Rodgers, Jr. | |
| 5,356,356 | A | 10/1994 | Hildebrandt et al. | |
| 5,514,053 | A | 5/1996 | Hawkins et al. | |
| 5,611,758 | A | 3/1997 | Rodgers, Jr. | |
| 6,042,518 | A | 3/2000 | Hildebrandt et al. | |
| 6,409,635 | B1 | 6/2002 | Maresh et al. | |
| 6,602,168 | B2 * | 8/2003 | Duke | 482/72 |

* cited by examiner

*Primary Examiner*—Stephen R. Crow

(74) *Attorney, Agent, or Firm*—Andrus, Sceales, Starke & Sawall, LLP

(57) ABSTRACT

The seated stepper is provided for exercising the lower body. The stepper includes a frame having opposite sides and a longitudinal axis, and a seat attached to the frame. First and second foot lever arrangements are pivotally coupled together on opposite sides of the frame to move alternately in forward and rearward directions towards forward and rearward positions. The foot lever arrangements have linearly moveable right and left foot receptacles adapted to be engaged by an exerciser's feet. First and second motion transfer arrangements are mounted on opposite sides of the frame and coupled to the foot lever arrangements for enabling reciprocating movement of one foot lever arrangement relative to the other foot lever arrangement. A transmission arrangement is mounted on the frame and is operably connected to the first and second motion transfer arrangements. The transmission arrangement includes upper and lower pulley and gear trains in meshing relationship with one another. A resistance structure is mounted to the frame and is operably connected to the transmission arrangement for resisting pivotal movement of each foot lever arrangement in one of the forward and rearward directions. The transmission arrangement enables either of the foot receptacles to be moved and prevents any inertia from the resistance structure from being transferred back to the foot lever arrangements.

20 Claims, 8 Drawing Sheets

SEATED STEPPER

FIELD OF THE INVENTION

This invention relates generally to exercise equipment for strengthening muscles and providing cardiovascular conditioning. More particularly, the invention pertains to a stepper for permitting exercising of the lower body while the exerciser maintains a seated position.

BACKGROUND OF THE INVENTION

One of the more popular exercise devices in widespread use today is a seated or recumbent stepper which provides aerobic exercise as well as development of the leg muscles. Such device combines the comfort and support of a seated or reclined exercise position with a striding type of exercise such as provided by conventional upright machines known to simulate stair climbing.

One of the concerns of steppers relates to the application of resistance and its role in maintaining a smooth, rhythmic motion through the course of an exercise session. Some steppers provide non-uniform or variable resistance because of the use of chains, cables and springs which do not provide solid linkages. The variable or jerking motions that sometimes occur can cause potential injury to exercisers. The maintaining of proper resistance in steppers is also a problem because of the arcuate or curved path of their exercise movements which can vary the mechanical lever created between the exerciser and the stepper. Such variation in lever position will change the amount of force exerted upon a stepper linkage and thus the resistance experienced by the exerciser. Some steppers seek to avoid the undesirable jerking sensation by implying a rack and pinion system. However, the use of a rack and pinion can create frictional forces that undesirably reduce the efficiency of the steppers and can cause significant wear of some stepper components. A further drawback is the large number and complex arrangement of parts which leads to higher costs of production and possible future maintenance requirements. It is also important to prevent any momentum or inertia generated by the stepper resistance arrangement from being transferred back to the exerciser after the stepping movement is terminated so as to avoid potential injury to the exerciser.

Accordingly, it is desirable to offer a differently styled seated stepper which overcomes the problems set forth above, and relies on a unique system of components interconnected in a particular relationship so as to provide a comfortable lower body exercise machine that operates in a smooth, controllable and synchronized manner.

SUMMARY OF THE INVENTION

It is a general object of the present invention to provide an exercise machine which uses an alternating linear stepping or leg pressing motion to provide a lower body workout.

It is one object of the present invention to provide a leg exercise machine that combines the comfort and support of a seated exercise position with a striding type of motion which will improve muscular and aerobic conditioning.

It is also an object of the present invention to provide a seated stepper which employs a specially designed transmission arrangement so as to enable reciprocating, synchronized movement of lower body limbs.

It is an additional object of the present invention to provide a seated stepper having a motion which is easily initiated by either foot of an exerciser.

It is another object of the present invention to provide a lower body exercise machine which maintains a smooth, selective resistance to an exercise movement to prevent any variable motion or feedback that may cause injury to an exerciser.

It is a further object of the present invention to provide a seated stepper which has adjustable resistance levels, is easy to use and may be mass produced at a reasonable cost.

In one aspect of the invention, a seated stepper is provided for exercising the lower body. The stepper includes a frame having opposite sides and a longitudinal axis, and a seat attached to the frame. First and second foot lever arrangements are pivotally coupled together on opposite sides of the frame to move alternately in forward and rearward directions toward forward and rearward positions. The foot lever arrangements have linearly moveable right and left foot receptacles adapted to be engaged by an exerciser's feet. First and second motion transfer arrangements are mounted on opposite sides of the frame and are coupled to the foot lever arrangements for enabling reciprocating movement of one foot lever arrangement relative to the other foot lever arrangement. A transmission arrangement is mounted on the frame and is operably connected to the first and second motion transfer arrangements. The transfer arrangement includes upper and lower pulley and gear trains in meshing relationship with one another. A resistance structure is mounted to the frame and is operably connected to the transmission arrangement for resisting pivotal movement of each foot lever arrangement in one of the forward and rearward directions. The transmission arrangement enables either of the foot receptacles to be moved and prevents any inertia from the resistance structure from being transferred back to the foot lever arrangements.

Each of the first and second motion transfer arrangements includes a member rotatably mounted to the frame, and a swing arm having a forward end pivotally joined to one of the foot lever arrangements and a rearward end pivotally secured to the rotatable member. One of the rotatable members on one side of the frame is coupled to the transmission arrangement by a main drive belt. Each of the rotatable members has a circular configuration and is located beneath the seat. One of the rotatable members is a main drive pulley and the other of the rotatable members is a flywheel. The transmission arrangement includes a rigid gear case holding the upper and lower pulley and gear trains, an upper idler pulley and a lower idler pulley. The upper pulley and gear train includes a rotatable upper clutch shaft having an upper shaft pulley mounted thereon, an upper shaft gear secured thereto and a pair of pillow block bearings secured to the shaft on both sides of the upper shaft gear. The lower pulley and gear train includes a rotatable lower clutch shaft having a lower shaft pulley with an internal one-way clutch mounted to the lower clutch shaft, a lower shaft gear with an internal one-way clutch secured to the lower clutch shaft, a pair of pillow block bearings secured to the lower clutch shaft on both sides of the lower shaft gear, and a brake drive pulley fixed on the lower clutch shaft. The main drive belt is engaged with the main drive pulley, the upper idler pulley, the upper shaft pulley, the lower shaft pulley and the lower idler pulley. The upper shaft gear is constantly engaged with the lower shaft gear. The brake drive pulley is operably connected to the resistance structure by a resistance drive belt. The transmission arrangement is constructed and arranged such that the brake drive pulley rotates in only one direction. The resistance structure is an eddy current brake/generator having a rotating disc. The upper clutch shaft and the lower clutch shaft have longitudinal axes which are disposed generally transverse to the longitudinal axis of the frame.

In another aspect of the invention, a seated stepper has a frame with opposite sides, a seat bottom mounted on the frame, first and second foot lever arrangements coupled to the frame to move in forward and rearward linear positions towards forward and rearward positions and resistance structure mounted on the frame for resisting movement of the foot lever arrangements in one of the forward and rearward directions. The invention is improved by a pulley and gear transmission arrangement mounted on the frame between the foot lever arrangements and the resistance structure for preventing any inertia from the resistance structure from being fed back to the foot lever arrangements so as to prevent injury to a exerciser. The foot lever arrangements are pivotally joined to opposite sides of the frame. The foot lever arrangements are coupled together so that they will move in unison. The transmission arrangement includes an upper pulley and gear train mounted on an upper cylindrical clutch shaft in constant meshing relationship with a lower pulley and gear train secured on a lower clutch shaft. The lower cylindrical clutch shaft includes a lower shaft pulley with an internal one-way clutch and a lower shaft gear with an internal one-way clutch. A longitudinal axis of the upper cylindrical clutch shaft is parallel to a longitudinal axis of the lower cylindrical clutch shaft.

Various other objects, features and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
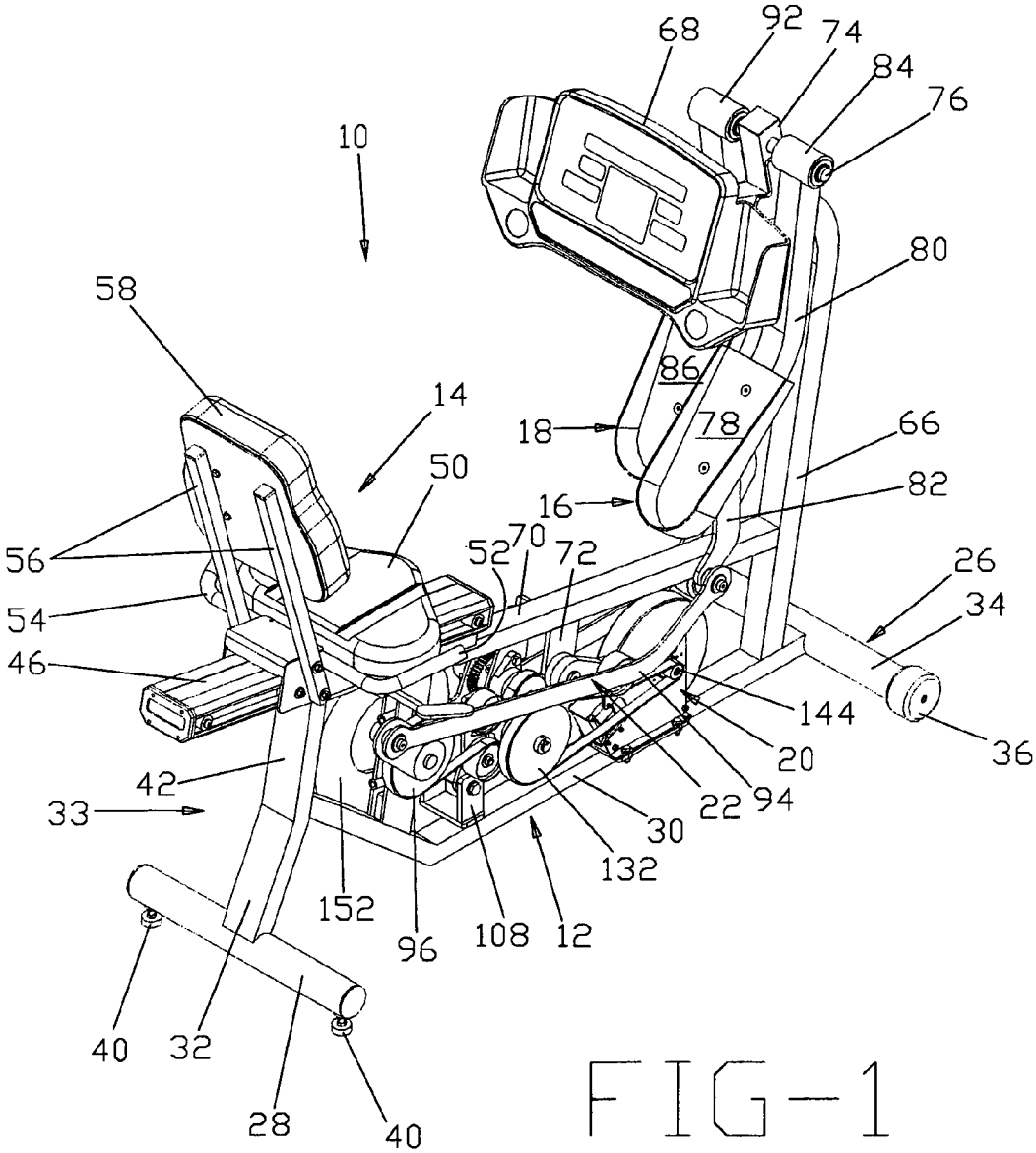
FIG. 1 is a right rear perspective view of the seated stepper embodying the present invention.
Figure 2:
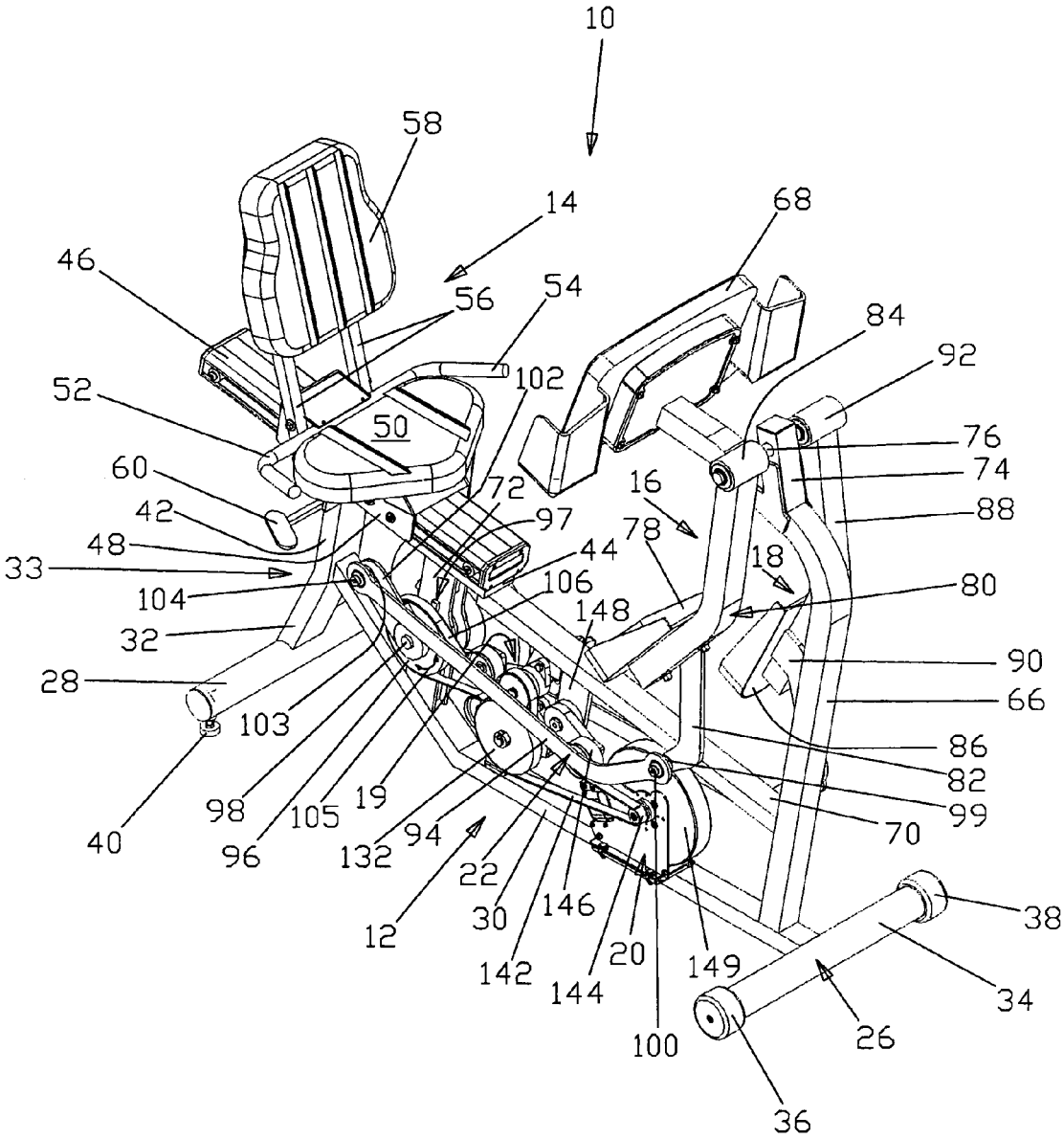
FIG. 2 is a right front perspective view of the seated stepper.

Referring now to FIGS. 1–4, a seated stepper 10 for providing muscular and cardiovascular conditioning of the lower body comprises a frame 12, a seat 14 adjustably secured to the frame 12, respective right and left foot lever arrangements 16, 18 pivotally joined to the frame and generally horizontally displaced from seat 14, a transmission arrangement 19, a single resistance structure 20, and right and left foot motion transfer systems 22, 24. Generally all the major components of the stepper 10 beneath the seat 14 are enclosed by a lower housing (not shown) that prevents inadvertent contact with the exerciser or the exerciser's clothing during the use of the stepper 10.

Frame 12 includes a front transverse member 26, a rear transverse member 28 and a longitudinally extending member 30 which extends linearly, rearwardly and angularly upwardly from the front transverse member 26 and terminates in a strut 33 having a lower branch 32 fixed to the center of the rear transverse member 28. The front transverse member 26 includes a cylindrical tube 34 having a pair of end caps 36, 38 mounted for rotation thereon. The end caps 36, 38 may function as wheels when stepper 10 is lifted from the rear and moved while the front transverse member 26 supports the stepper 10. The bottom of the rear transverse member 28 is provided with a rotatable adjustment device 40 to slightly change the vertical position at the rear of the stepper 10, if desired. An upper branch 42 of the strut 33 extends upwardly and slightly forwardly, and is integrally formed with a downwardly and forwardly projecting section 44 which supports a seat tube 46.

Slidably supported on the seat 46 is a saddle 48 to which is mounted a seat bottom 50 provided with a pair of grab handles 52, 54 laterally thereof. Also attached to the saddle 48 is a framework 56 for supporting a seat back 58 typically at an obtuse angle relative to the seat bottom 50. The saddle 48 includes an adjustment mechanism 60 to permit sliding adjustment of the seat 14 depending on the size of the exerciser. For optimum cardiovascular results, the seat 14 is designed to be placed at a height such that the seated exerciser's heart is located above the foot lever arrangements 16, 18.

The frame 12 also includes at its front end a forwardly, upwardly and rearwardly extending, curved support arm 66 for positioning a control panel 68 forwardly of the seat 14. A forward end of a support bar 70 is attached to the support arm 66, and a rearward end of the support bar 70 is secured beneath the seat supporting section 44. A mounting brace 72 extends between the seat supporting section 44 and the angular rear portion of member 30. An upper portion of curved support arm 66 located beneath the control panel 68 carries a short extension 74 for supporting a fixed shaft 76 oriented generally transversely to a vertical plane bisecting the seat bottom 50.

The right foot lever arrangement 16 includes a foot receptacle 78 having an upper arm 80 and a lower arm 82. A top end of the upper arm 80 is provided with a first cylindrical bearing assembly 84 rotatably mounted about a right end of the shaft 76. Similarly, the left foot lever arrangement 18 includes a foot receptacle 86 having an upper arm 88 and a lower arm 90. A top end of the upper arm 88 is equipped with a second cylindrical bearing assembly 92 rotatably mounted about a left end of the shaft 76. As will be appreciated hereafter, the right and left foot lever arrangements 16, 18, respectively, are coupled or tied together to an upper part of frame curved support arm 66 in such a manner that the foot lever arrangements 16, 18 can pivot forwardly and rearwardly of each other with the foot receptacles 78 and 86 moving in a linear path back and forth.

The right and left foot motion transfer systems 22, 24 are employed to transfer motion from the right and left foot lever arrangements 16, 18 respectively, through the transmission arrangement 19 to the resistance structure 20.

Figure 7:
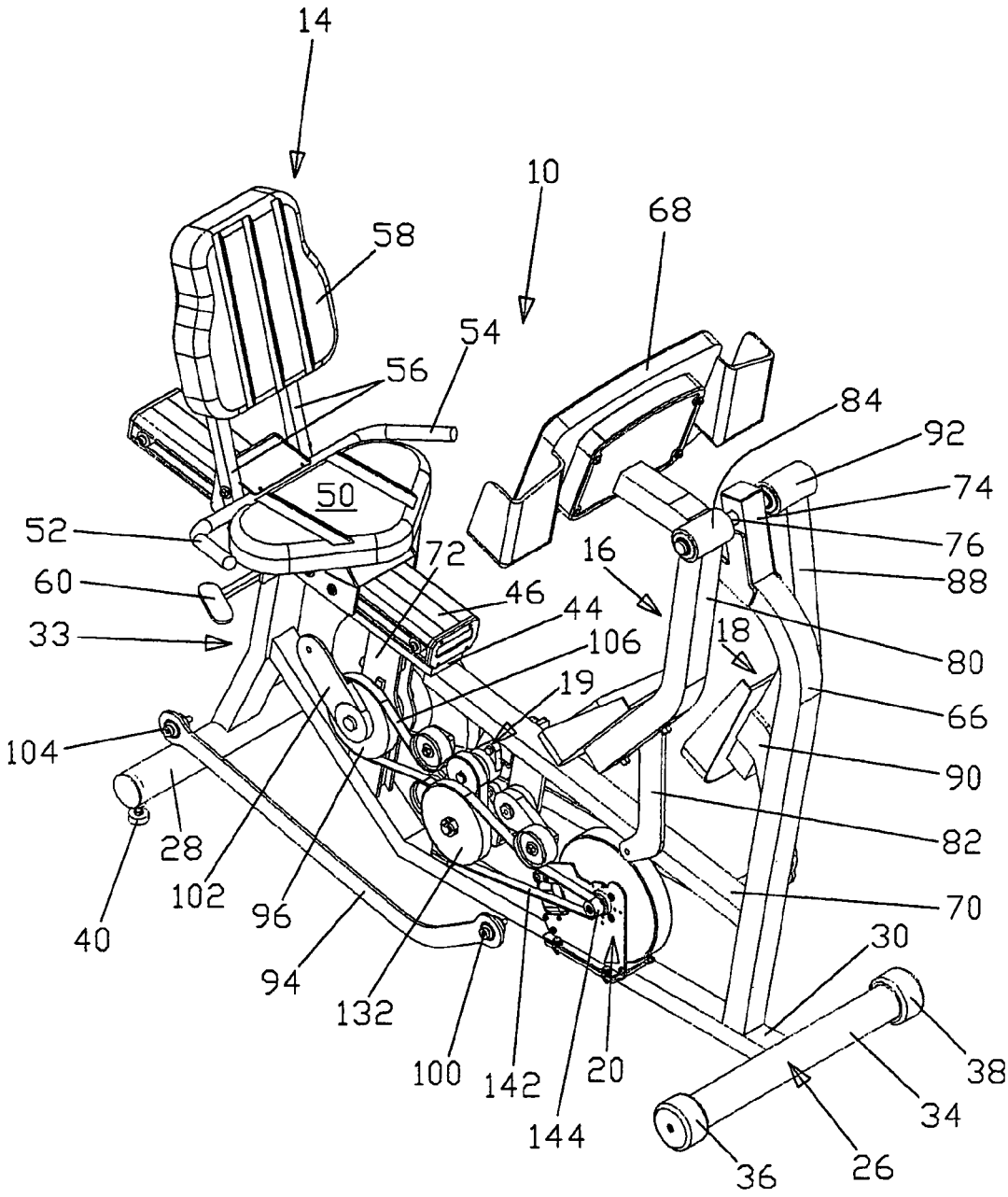
FIG. 7 is another view similar to FIG. 2 showing only the right swing arm broken away from the seated stepper.

The right foot motion transfer system 22 includes a moveable, upwardly angled, right side swing arm 94 (FIG. 7) and a rotatable, circular main drive pulley 96 located beneath the seat 14. The drive pulley 96 is rigidly mounted (such as by welding) for rotation on a shaft 98 which is rotatably supported by a bearing assembly 97 (FIG. 2) on frame brace 72. The right side swing arm 94 has a forward end which is pivotally connected to a bottom end of the right foot lower arm 82 via a pair of bearings 99 (FIG. 2) and a pin 100. The right side swing arm 94 has a rearward end which is pivotally connected to the end of a lever arm 102 extending from the center of the main drive pulley 96 via a pair of bearings 103 on a pin 104. That is, the rearward end of the right side swing arm 94 is effectively pivotally connected to the main drive pulley 96 so that forward movement of the right side swing arm 94 will cause the main drive pulley 96 to rotate in a clockwise direction as shown by the arrow 105 in FIG. 2. The main drive pulley 96 is connected by a main drive belt 106 to the transmission arrangement 19.

Figure 5:
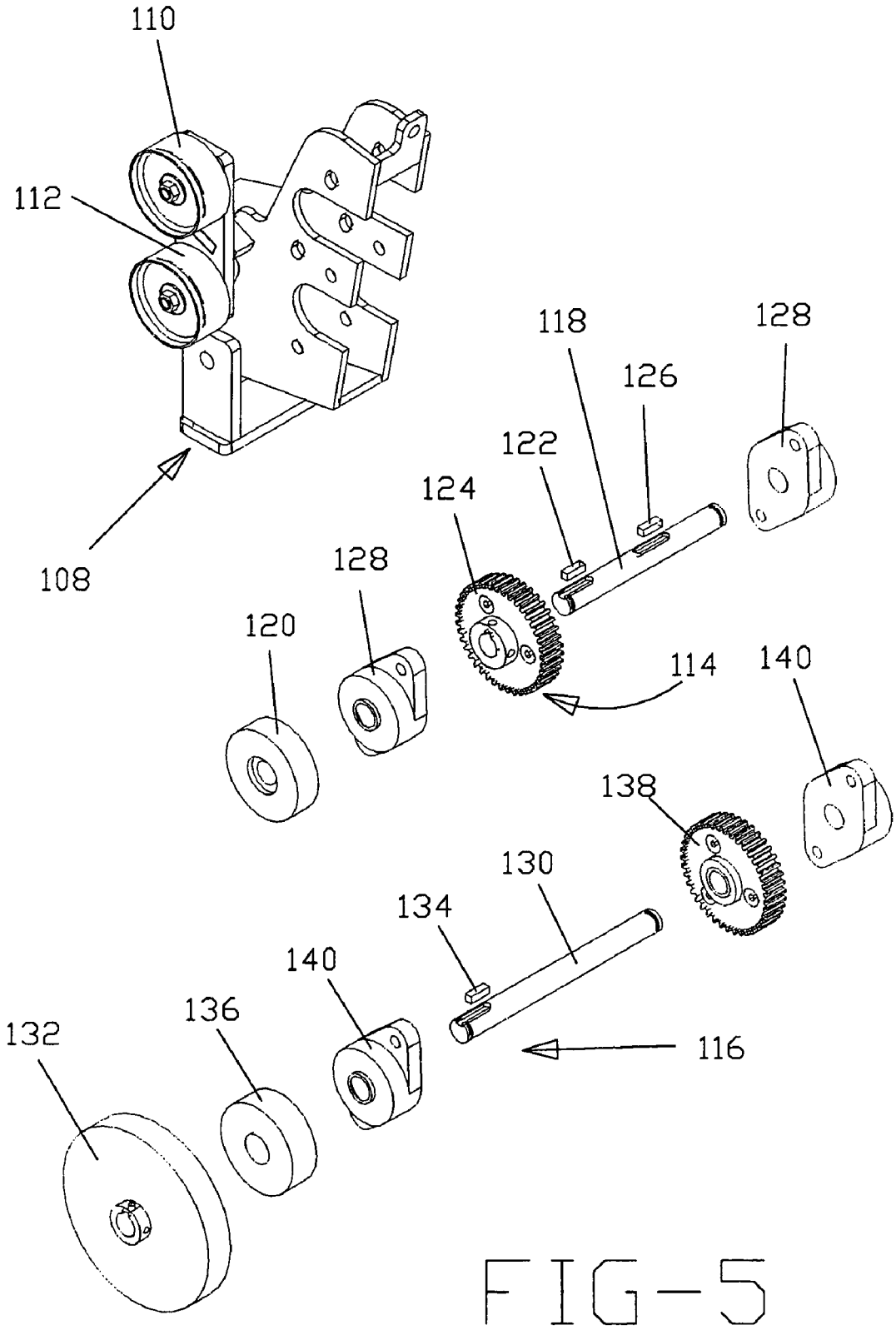
FIG. 5 is an exploded view of the transmission arrangement used in the seated stepper.
Figure 6:
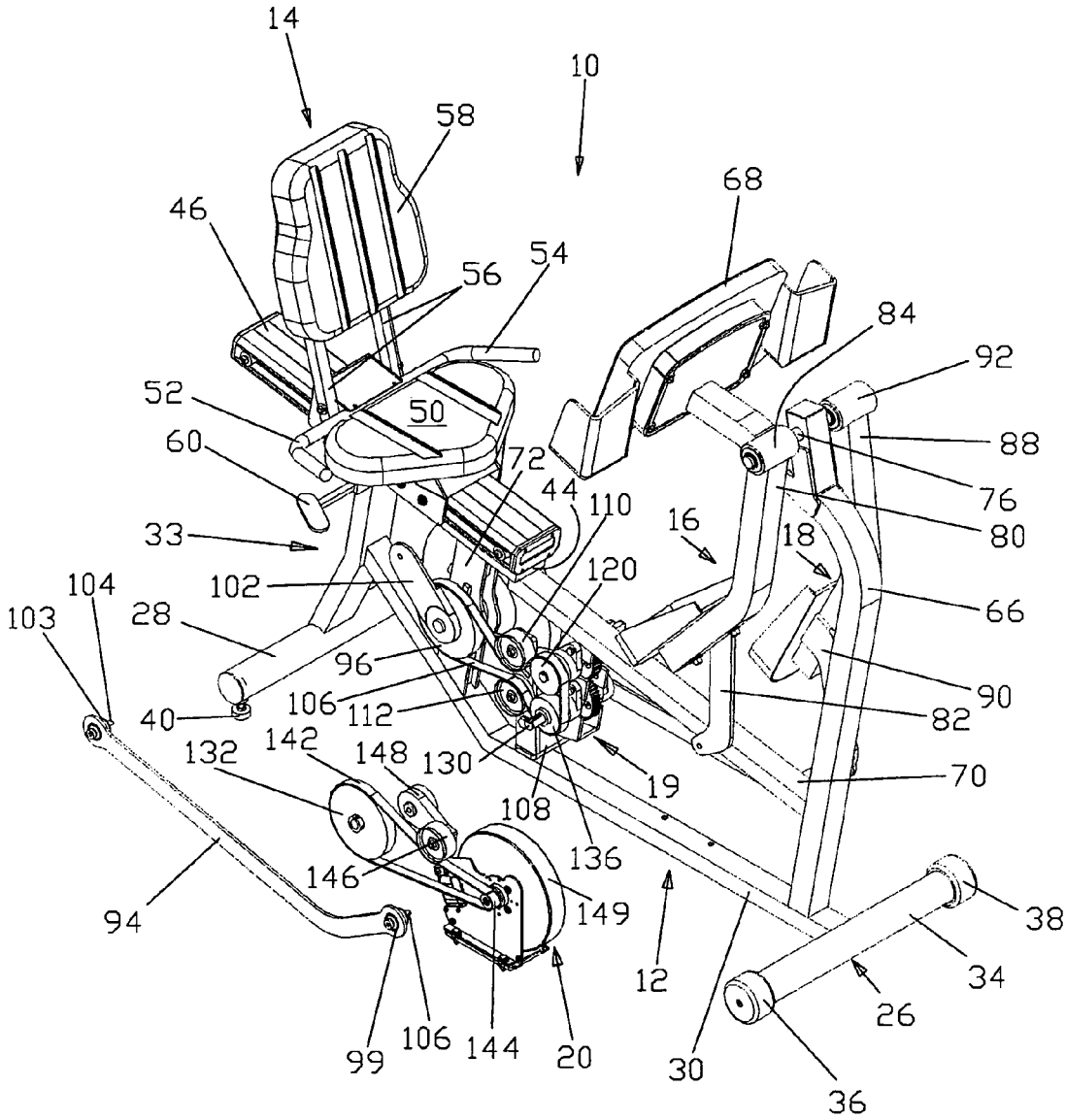
FIG. 6 is a view similar to FIG. 2 showing the right swing arm and the resistance device broken away from the seated stepper.

As best seen in FIGS. 5 and 6, the transmission arrangement 19 is mounted in a rigid gear case 108 which is fixed to the frame member 30 and the support bar 70. The gear case 108 provides a mounting for an upper rotatable idler pulley 110 and a lower rotatable idler pulley 112. Also mounted on the gear case 108 is an upper pulley and gear train 114 and a lower pulley and gear train 116. Upper gear train 114 includes an upper, cylindrical clutch shaft 118 having an upper pulley 120 rigidly mounted by a locking key 122. An upper gear 124 is fixedly attached to the shaft 118 by a locking key 126, and the gear 124 is flanked on both sides by a pair of pillow block bearings 128 fixed to the upper clutch shaft 118. Lower gear train 116 includes a lower, cylindrical clutch shaft 130 having a brake drive pulley 132 attached thereto by a locking key 134. The respective longitudinal axes of the clutch shafts 118, 130 are parallel to each other. A lower pulley 136 with an internal one-way clutch is installed on the lower clutch shaft 130 in a manner such that when rotated clockwise, the clutch engages the lower clutch shaft 130 and causes the shaft 130 to also rotate clockwise. A lower gear 138 with an internal one-way clutch is joined on the lower clutch shaft 130 so that when rotated clockwise, the clutch engages the shaft 130 and causes the shaft 130 to rotate clockwise. A pair of pillow block bearings 140 is fixed to the lower clutch shaft 130 on both sides of the lower gear 138.

As shown in FIG. 6, the main drive belt 106 engaging the main drive pulley 96 passes under the upper idler pulley 110 around the upper shaft pulley 120 and the clutch lower shaft pulley 136 and over the lower idler pulley 112. The purpose of the upper and lower idler pulleys 110, 112 is to increase the contact area of the main drive belt 106 on the upper shaft pulley 120 and the clutch lower shaft pulley 136 to prevent slippage. The transmission arrangement 19 contributes to the smooth, rhythmic motion of the stepper 10 throughout the entire exercise.

The brake drive pulley 132 is connected by a resistance drive belt 142 to a rotatable spool 144 of the resistance structure 20 which is fixed to the frame member 30. The resistance drive belt 142 also passes under a belt tensioner 146 which is attached by a bracket 148 (FIG. 2) to the support arm 70. The resistance structure 20 preferably takes the form of an eddy current brake/generator which is electronically connected to the controller 68 where the exerciser may vary the resistance applied during exercise. The brake/generator 20 typically includes a rotating brake disc 149 which builds inertia or momentum due to rotation of brake pulley 132. Also included in brake/generator 20 is a brake coil (not shown) which is electrically controllable by the controller 68 to vary pulses in the coil which will control rotation of the disc 149. It should be understood that other types of resistance structure may also be employed in lieu of the brake/generator 20.

Figure 8:
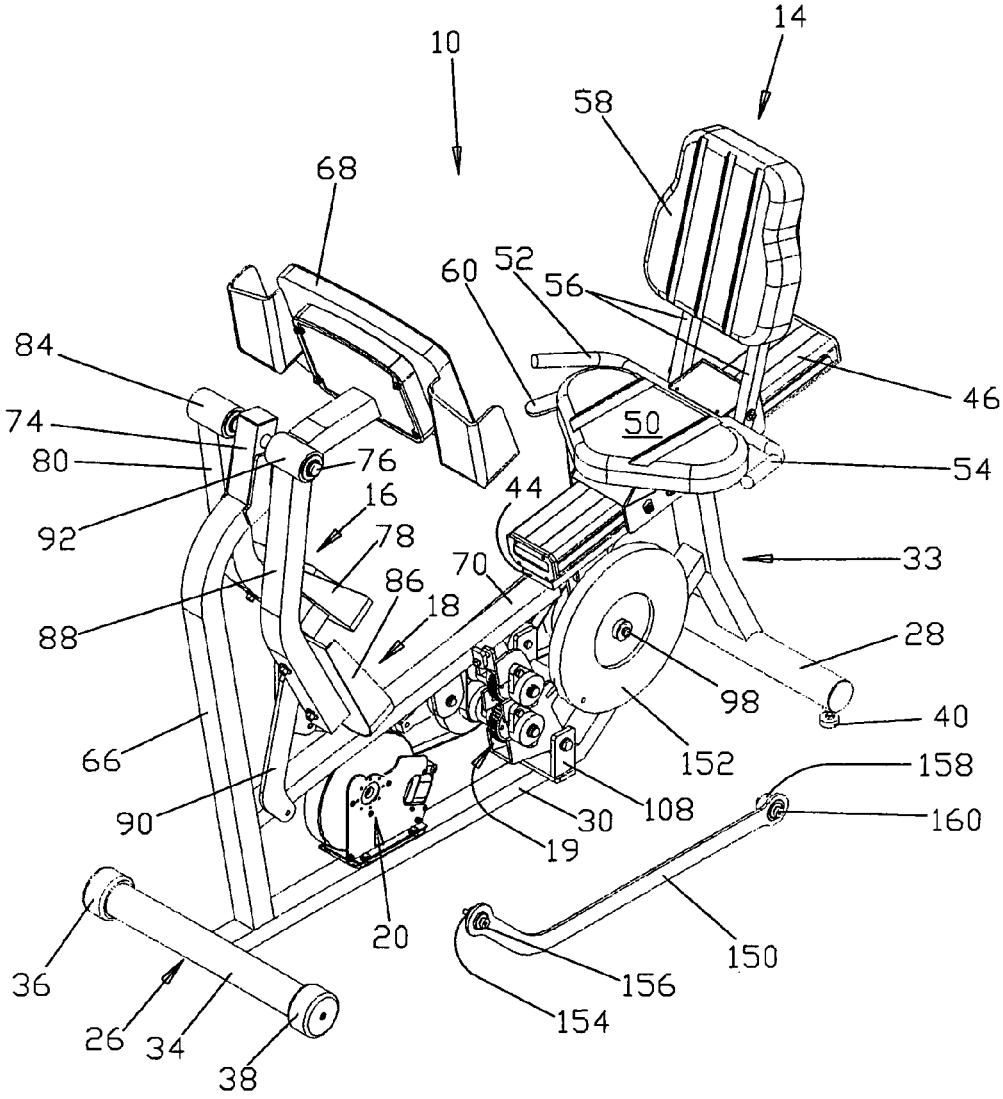
FIG. 8 is a view similar to FIG. 3 showing the left swing arm broken away from the seated stepper.

The left foot motion transfer system 24 includes a moveable, upwardly angled left side swing arm 150 (FIG. 8), and a circular flywheel 152 rigidly mounted for rotation on the shaft 98. The flywheel 152 and main drive pulley 96 are mounted on shaft 98 so that both members 96, 152 will simultaneously rotate. The left side swing arm 150 has a forward end which is pivotally connected to a bottom end of the left foot lower arm 90 via a pair of bearings 154 (FIG. 4) and a pin 156. The left side swing arm 150 has a rearward end which is pivotally connected to the periphery of the flywheel 152 by a pivot bearing 158 and a pin 160. With this construction, rearward movement of the left side swing arm 150 will cause the flywheel 152 to rotate in the counterclockwise direction as shown by the arrow 162 in FIG. 4.

It should be understood that the right and left side swing arms 94, 150 are respectively connected to the main drive pulley 96 and flywheel 152 so that when the right foot lever arrangement 16 is driven forward, the left foot lever arrangement 18 is driven in synchronism rearwardly as depicted in FIGS. 1–4.

Figure 3:
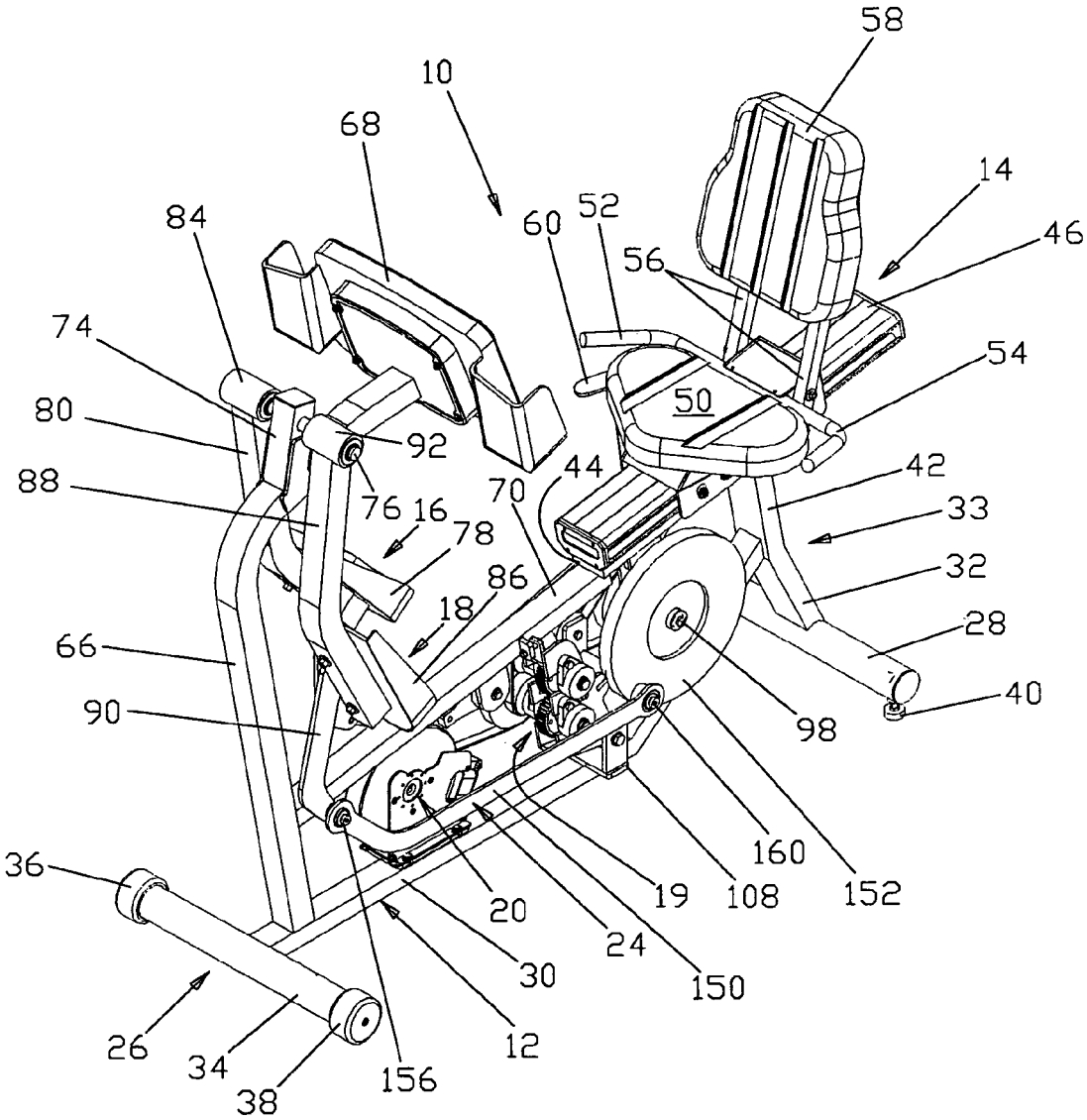
FIG. 3 is a left front perspective view of the seated stepper.

When the exerciser is comfortably positioned in the adjustable seat 14, one places his/her feet in the respective foot receptacles 78, 86 of the right and left foot lever arrangements 16, 18 having starting positions as shown in FIGS. 1–4. Referring to FIG. 3, when foot pressure is applied by the left foot against the left foot receptacle 86, the left foot lever arrangement 18 rotates forwardly about bearing assembly 92 in the direction of arrow 164 about the shaft 76 so that the foot receptacle 86 moves in a linear path. The left side swing arm 150 moves correspondingly forward causing the flywheel 152 and shaft 98 to rotate in a clockwise direction facing the flywheel. This in turn rotates the main drive pulley 96 in a counterclockwise direction as viewed in FIG. 1. The lever arm 102 which is connected to the main drive pulley 96 pulls the right side swing arm 94 rearward which, in turn, pulls the right lever foot arrangement 16 and the exerciser's right leg rearward. The inertia created by the flywheel 152 rotating in this motion is enough to continue the movement of the left foot lever arrangement 18 to the forward limit of its motion, and cause a smooth transition to a rearward movement of the left foot lever arrangement 18. At this time, the right foot lever arrangement 16 is pushed forward by the exerciser's right foot.

When the main drive pulley 96 is rotated in a counterclockwise direction, the main drive belt 106 rotates the upper shaft pulley 120 and the clutch lower shaft pulley 136 in a counterclockwise direction. Because the clutch and the lower shaft pulley 136 will only transmit motion to the lower clutch shaft 130 when turned in a clockwise direction, the lower shaft pulley 136 "idles". The upper shaft pulley 120 when rotated counterclockwise, compels the upper shaft gear 124 to rotate in a counterclockwise direction. The upper shaft gear 124 meshed to the lower shaft gear 138 causes the lower shaft gear 138 to rotate clockwise. Because the clutch in the lower shaft gear 138 transmits motion to the lower clutch shaft 130 when rotated clockwise, the brake drive pulley 132 is rotated clockwise. Because the brake drive pulley 132 is operably connected to the resistance structure 20, resistance is applied to the left foot lever arrangement 18.

Figure 4:
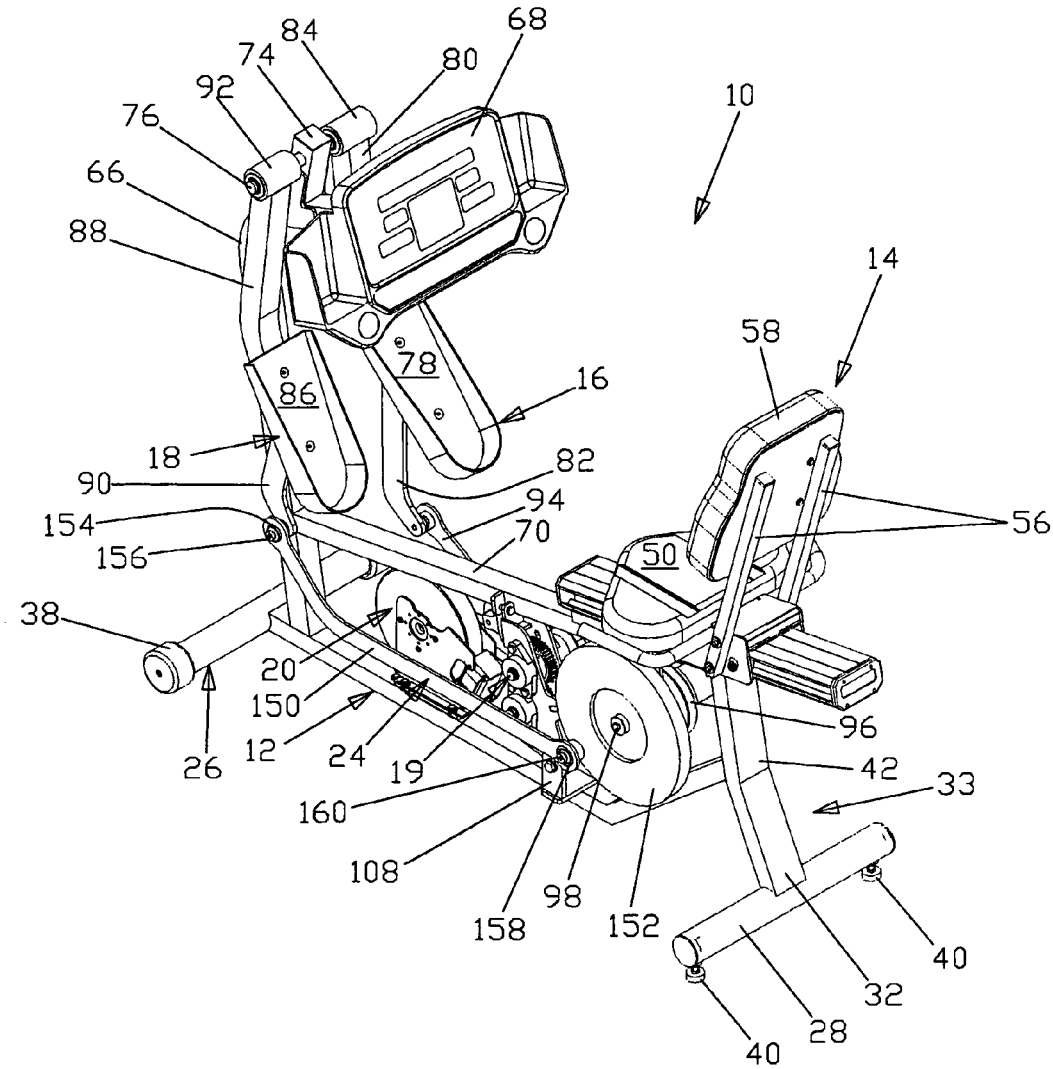
FIG. 4 is a left rear perspective view of the seated stepper.

When the exerciser initially presses down on the right foot receptacle 78 of the right foot lever arrangements 16 with his foot, the foot receptacle 78 moves in a linear path and the right side swing arm 94 moves forward causing the main drive pulley 96 and flywheel 152 to rotate in a counterclockwise direction as seen in FIG. 4. The inertia created by the flywheel 152 rotating in this motion is enough to continue the movement on the right foot lever arrangement 16 to the forward limit of this motion, and cause a smooth transition to a rearward movement of the right foot lever arrangement 16. At this time, the left foot lever arrangement 18 is pushed forward by the exerciser's left foot.

When the main drive pulley 96 is rotated in a clockwise direction, the main drive belt 106 rotates the upper shaft pulley 120 and the clutch lower shaft pulley 136 in a clockwise direction. Because the clutch in the lower shaft pulley 136 will rotate the lower clutch shaft 130 when rotated in a clockwise direction, the brake drive pulley 132 connected to the resistance structure 20 is caused to rotate in a clockwise direction so that resistance is applied to the right foot lever arrangement 16. The upper shaft pulley 120, when rotated clockwise, compels the upper shaft gear 124 to rotate in a clockwise direction. The upper shaft gear 124 meshed to the lower shaft gear 138, causes the lower shaft gear 138 to rotate in a counterclockwise direction. Because the one-way clutch in the lower shaft gear 138 only transmits motion to the lower clutch shaft 130 when rotated in a clockwise direction, the gear 138 holds "idles" on the shaft 130.

Regardless of whether the main drive pulley 96 is rotated clockwise or counterclockwise, the brake drive pulley 132 will always rotate in a clockwise rotation. When the main drive pulley 96 is stopped by not pressing either of the foot receptacles 78, 86, inertia of the resistance mechanism 20, because of its high speed of rotation, will not stop but will not be transmitted to the drive pulley 96. The clutch is in the clutch lower shaft pulley 136 in the clutch gear 138 will both "idle".

The brake/generator 20 is electronically controlled by the exerciser to produce resistance of the rotation of the main drive pulley 96 determining the pressure required by the exerciser to press the foot receptacles 78 and 86 into a forward position. Reciprocating, synchronized movement of the right and left foot lever arrangement 16, 18 continues as described above until foot pressure on the forwardly and linearly moving foot receptacle 78 or 86 is stopped terminating that particular exercise session.

As previously mentioned, the stepper 10 includes a control panel 68 which is programmed so that it will provide information to the exerciser with respect to the distance traveled, time elapsed, speed (RPM), resistance, etc. The exerciser may control certain or all of these parameters by a touch-type screen. The control panel 68 can be powered by a battery (not shown) mounted on the frame 12.

It should be appreciated that the present invention provides a seated stepper wherein each of the foot receptacles 78, 86 of the foot lever arrangement 16, 18 is smoothly moved at all times in opposite linear directions and in synchronism without relying on chains, springs and gear/rack combinations, and without the potential for injury to the exerciser.

While the invention has been described with reference to a preferred embodiment, those skilled in the art will appreciate that certain substitutions, alterations, and omissions may be made without departing from the spirit thereof. Accordingly, the foregoing description is meant to be exemplary only and should not be deemed limitative on the scope of the invention set forth with the following claims.

I claim:

1. A seated stepper for exercising the lower body comprising:

a frame having opposite sides and a longitudinal axis;

a seat attached to the frame;

first and second foot lever arrangements pivotally coupled together on opposite sides of the frame to move alternately in forward and rearward directions towards forward and rearward positions, and having linearly moveable right and left foot receptacles adapted to be engaged by an exerciser's feet;

first and second motion transfer arrangements mounted on opposite sides of the frame and coupled to the foot lever arrangements for enabling reciprocating movement of one foot lever arrangement relative to the other foot lever arrangement;

a transmission arrangement mounted on the frame and operably connected to the first and second motion transfer arrangements, the transmission arrangement including upper and lower pulley and gear trains in meshing relationship with one another; and a resistance structure mounted to the frame and operably connected to the transmission arrangement for resisting pivotal movement of each foot lever arrangement in one of the forward and rearward directions, whereby the transmission arrangement enables either of the foot receptacles to be moved and prevents any inertia from the resistance structure from being transferred back to the foot lever arrangements.

2. The stepper of claim 1, wherein each of the first and second motion transfer arrangements includes a member rotatably mounted to the frame, and a swing arm having a forward end pivotally joined to one of the foot lever arrangements, and a rearward end pivotally secured to the rotatable member.

3. The seated stepper of claim 2, wherein one of the rotatable members on one side of the frame is coupled to the transmission arrangement by a main drive belt.

4. The seated stepper of claim 2, wherein each of the rotatable members has a circular configuration and is located beneath the seat.

5. The seated stepper of claim 3, wherein one of the rotatable members is a main drive pulley and the other of the rotatable members is a flywheel.

6. The seated stepper of claim 5, wherein the transmission arrangement includes a rigid gear case holding the upper and lower pulley and gear trains, an upper idler pulley and the lower idler pulley.

7. The seated stepper of claim 6, wherein the upper pulley and gear train includes a rotatable upper clutch shaft having an upper shaft pulley mounted thereon, an upper shaft gear secured thereto and a pair of pillow block bearings secured to the shaft on both sides of the upper shaft gear.

8. The seated stepper of claim 7, wherein the lower pulley and gear train includes a rotatable lower clutch shaft having a lower shaft pulley with an internal one-way clutch mounted to the lower clutch shaft, a lower shaft gear with an internal one-way clutch secured to the lower clutch shaft, a pair of pillow block bearings secured to the lower clutch shaft on both sides of the lower shaft gear, and a brake drive pulley fixed on the lower clutch shaft.

9. The seated stepper of claim 8, wherein the main drive belt is engaged with the main drive pulley, the upper idler pulley, the upper shaft pulley, the lower shaft pulley and the lower idler pulley.

10. The seated stepper of claim 8, wherein the upper shaft gear is constantly engaged with the lower shaft gear.

11. The seated stepper of claim 8, wherein the brake drive pulley is operably connected to the resistance structure by a resistance drive belt.

12. The seated stepper of claim 8, wherein the transmission arrangement is constructed and arranged such that the brake drive pulley rotates in only one direction.

13. The seated stepper of claim 1, wherein the resistance structure is an eddy current brake/generator having a rotating disc.

14. The seated stepper of claim 8 wherein the upper clutch shaft and the lower clutch shaft have longitudinal axes which are disposed generally transverse to the longitudinal axis of the frame.

15. In a seated stepper having a frame with opposite sides, a seat bottom mounted on the frame, first and second foot lever arrangements coupled to the frame to move in forward and rearward linear directions towards forward and rearward positions and resistance structure mounted on the frame for resisting movement of the foot lever arrangements and one of the forward and rearward directions, the improvement comprising:

a pulley and gear transmission means mounted on the frame between the foot lever arrangements and the resistance structure for preventing any inertia from the resistance structure from being fed back to the foot lever arrangements so as to prevent injury to a stepper exerciser.

16. The improvement of claim 15, wherein the foot lever arrangements are pivotally joined to opposite sides of the frame.

17. The improvement of claim 15, wherein the foot lever arrangements are coupled together so that they move in unison.

18. The improvement of claim 15, wherein the transmission arrangement includes an upper pulley and gear train mounted on an upper cylindrical clutch shaft in constant meshing relationship with a lower pulley and gear train secured on a lower cylindrical clutch shaft.

19. The improvement of claim 18, wherein the lower cylindrical clutch shaft includes a lower shaft pulley with an internal one-way clutch and a lower shaft gear with an internal one-way clutch.

20. The improvement of claim 18, wherein a longitudinal axis of the upper cylindrical clutch shaft is parallel to a longitudinal axis of the lower cylindrical clutch shaft.

* * * * *